000046 0640 -00 10-07-80 28330 09-04-80 042812 781470 04226602 1805

United States Patent [19]

Fukuda

[11] 4,226,602

[45] Oct. 7, 1980

[54] METHOD OF CONTINUOUSLY PRODUCING RESINOID ABRASIVE WHEELS FOR CUTTING HARD MATERIALS

[76] Inventor: Heijiro Fukuda, 123, 3-chome, Umegaoka, Nagaokakyo, Kyoto, Japan

[21] Appl. No.: 971,570

[22] Filed: Dec. 20, 1978

[30] Foreign Application Priority Data

Dec. 22, 1977 [JP] Japan ..... 52-155291

[51] Int. Cl.[2] ..... C09K 3/14

[52] U.S. Cl. ..... 51/296; 51/298; 51/302

[58] Field of Search ..... 51/295, 298, 293, 296, 51/302

[56] References Cited

U.S. PATENT DOCUMENTS

| | | | |
|---|---|---|---|
| 3,476,537 | 11/1969 | Markotan | 51/296 |
| 3,950,148 | 4/1976 | Fukuda | 51/298 |
| 3,950,149 | 4/1976 | Fukuda | 51/298 |
| 4,038,047 | 7/1977 | Haywood | 51/296 |
| 4,086,067 | 4/1978 | Busch | 51/296 |
| 4,115,077 | 9/1978 | Fukuda | 51/298 |

*Primary Examiner*—Donald J. Arnold
*Attorney, Agent, or Firm*—Armstrong, Nikaido, Marmelstein & Kubovcik

[57] ABSTRACT

Resinoid abrasive wheels are continuously produced by preparing pore forming granules having predetermined mechanical strength and containing a substance thermally decomposable at a baking temperature for the production of resinoid abrasive wheels and a blowing agent, kneading the pore forming granules with abrasive grains and a thermosetting synthetic resin binder to prepare an abrasive composition, molding the abrasive composition into a block, heating the block by a high frequency heater, rolling the heated block into a sheet by a multiplicity of pairs of rolls, blanking out circular pieces from the sheet, and baking the circular pieces to cure the binder therein and form pores by the decomposition of at least part of the thermally decomposable substance contained in the granules and by the decomposition of the blowing agent contained in the granules. The resinoid abrasive wheels obtained have pores uniformly dispersed therein.

16 Claims, 7 Drawing Figures

METHOD OF CONTINUOUSLY PRODUCING RESINOID ABRASIVE WHEELS FOR CUTTING HARD MATERIALS

BACKGROUND OF THE INVENTION

The present invention relates to a method of continuously producing resinoid abrasive wheels for cutting hard metal materials, especially superhard metal materials such as stainless steel and special steel.

Generally pores play an important role in resinoid abrasive wheels for cutting hard materials. When a hard metal material is cut by such a resinoid abrasive wheel, the pores in the wheel permit escape of particles of the cut material and reduce heat generation during the cutting operation. The presence of the pores further permits abrasion of the wheel, thereby refreshing the abrasive surface at all times so that the wheel retains a high cutting performance for a prolonged period of time. Accordingly such effects are not achievable if the amount of the pores is less than is desired, whereas the presence of an excessive amount of pores will reduce the strength of the wheel. Thus the amount of the pores is closely related to the cutting performance and strength of the abrasive wheel. It is therefore desired that a suitable amount of pores be present in the abrasive wheel in a well-balanced uniform distribution.

I have already proposed in U.S. Pat. No. 4,115,077 a method of continuously producing resinoid abrasive wheels containing pores uniformly distributed therein, comprising the steps of preparing pore forming granules having predetermined mechanical strength and containing a substance thermally decomposable at a baking temperature for the production of resinoid abrasive wheels, kneading the pore forming granules with abrasive grains, a binder, a glass fiber reinforcement and a filler to prepare an abrasive composition, molding the composition into a block, heating the block by a high frequency heater, rolling the block into a sheet by rolls, blanking out circular pieces from the sheet, and baking the circular pieces of the uncured abrasive composition containing the pore forming granules uniformly dispersed therein to cure the binder and form pores by the decomposition of at least part of the thermally decomposable substance in the granules. However, since the pore forming granules used in the proposed method contain only a thermally decomposable substance such as starch, the pores produced on baking are relatively small, so that the abrasive wheel obtained still remains to be improved in cutting performance.

SUMMARY OF THE INVENTION

The main object of this invention is to provide a method of continuously producing resinoid abrasive wheels having an improved cutting ability.

The method of this invention comprises the steps of preparing pore forming granules having predetermined mechanical strength and containing a substance thermally decomposable at a baking temperature for the production of the resinoid wheel and a blowing agent, kneading the pore forming granules with abrasive grains and a thermosetting synthetic resin binder to prepare an abrasive composition, molding the abrasive composition into a block, heating the block by a high frequency heater, rolling the heated block containing the pore forming granules into a sheet by a multiplicity of pairs of rolls, blanking out a circular piece from the rolled sheet, and baking the circular piece to cure the binder and form pores in the resulting abrasive wheel by the decomposition of at least part of the thermally decomposable substance contained in the granules and by the decomposition of the blowing agent contained in the granules.

According to the method of this invention, resinoid abrasive wheels can be produced continuously which contain a desired amount of sufficiently large pores as uniformly distributed therein and which therefore exhibit outstanding cutting performance and high mechanical strength.

The outstanding properties of the wheels thus obtained are attributable to the presence of the blowing agent conjointly used with starch or like thermally decomposable substance as contained in the pore forming granules so that pores of sufficient volume can be formed effectively. If the pore forming granules contain the thermally decomposable substance such as starch alone, the substance will partly remain undecomposed in the course of the baking step, permitting formation of small pores only and making it impossible to form pores larger than the granules in volume, whereas the conjoint use of the blowing agent with the thermally decomposable substance permits the formation of pores larger than the granules or grains used. The blowing agent can be dispersed in and mixed with the unbaked composition uniformly as if it were protected by the pore forming granules, with the result that pores can be formed as desired with ease in respect of size, amount and distribution. The resinoid abrasive wheels produced by the present method therefore have high mechanical strength and outstanding cutting performance in that they are very sharp, give a cut surface free of any scorch or distortion and cut materials accurately at right angles to the axis thereof.

The pore forming granules incorporated into the abrasive composition have such mechanical strength that they withstand the pressure of pairs of rolling rolls without breaking down. The abrasive composition resulting from the kneading step and containing the pore forming granules can therefore be subjected, free of any trouble, to a series of steps of molding the composition into a block, heating the block by a high frequency heater, rolling the block into a sheet, and blanking out circular piece from the sheet, whereby resinoid abrasive wheels having excellent cutting performance and high mechanical strength as mentioned above can be produced in large quantities, with high efficiency and at a low cost.

According to another feature of this invention, hard hollow granules are incorporated into the abrasive composition along with the pore forming granules, and the composition is subjected to the steps described above, such that pores are formed in the final baking step by the thermal decomposition of the blowing agent contained in the granules and by the decomposition of at least part of the thermally decomposable substance contained in the granules. The resulting abrasive wheel thus contains the pores and the hard hollow granules.

The method of this invention thus characterized gives resinoid abrasive wheels containing a large number of pores and hard hollow granules as uniformly distributed therein. The hard hollow granules act to cut metal materials like abrasive grains while at the same time providing their hollow portion as a pore when broken, thus giving an increased cutting ability to the abrasive wheel.

DESCRIPTION OF THE PREFERRED EMBODIMENTS

Figure 1:
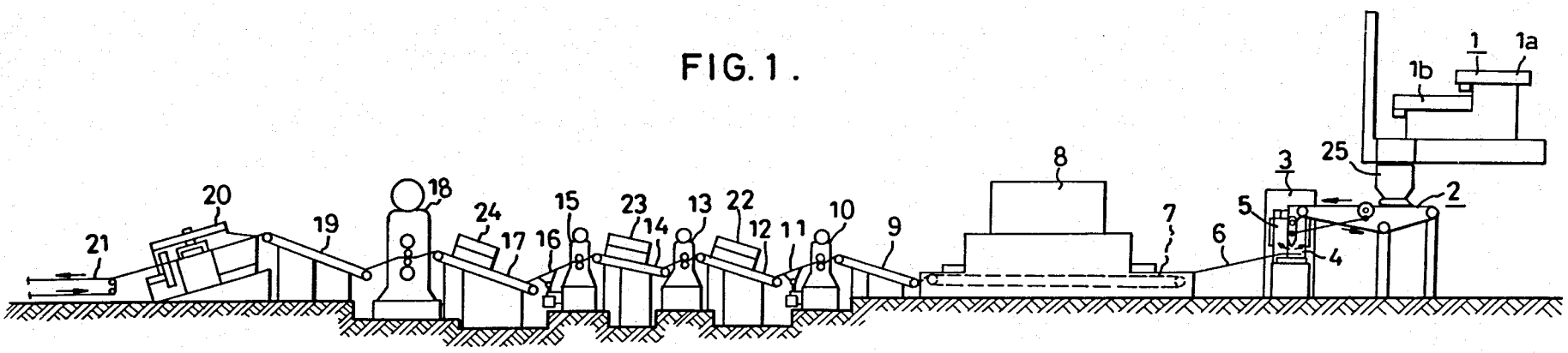
FIG. 1 is a schematic side elevation showing an example of the apparatus for continuously producing resinoid abrasive wheels of this invention.
Figure 2:
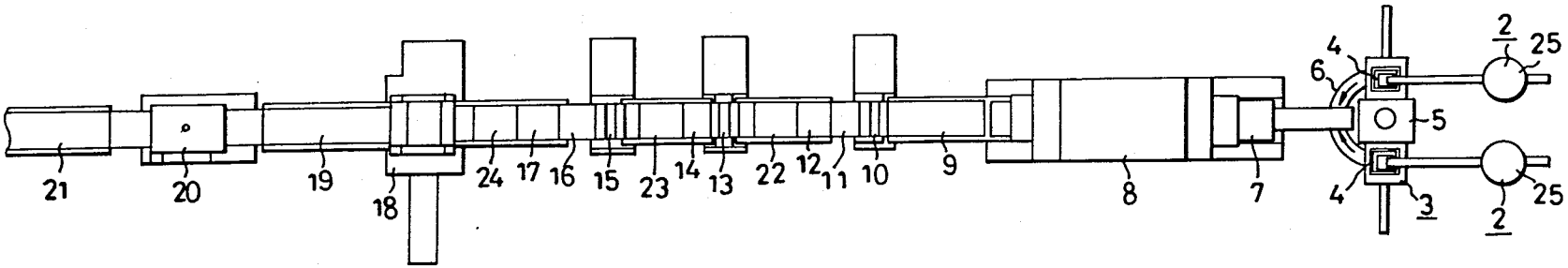
FIG. 2 is a plan view showing the apparatus of FIG. 1.

With reference to FIGS. 1 and 2, abrasive grains A, a binder B, an inorganic fiber reinforcement C, pore forming granules D and, when desired, hard hollow globules E and a filler in predetermined proportions are kneaded in a two-stage mixer 1 to prepare an abrasive composition.

Examples of useful abrasive grains A are about 16- to 220-mesh grains of silicon carbide, alumina, siliceous sand, etc. Suitable as binders B are phenolic resin, epoxy resin, diallyl phthalate resin and like thermosetting synthetic resins. These resins are used partly in the form of a liquid. For example, one third of the whole amount of the resin is used in liquid, and the remaining two thirds in particles.

The pore forming granules D are composed of a substance which is thermally decomposable at a baking temperature of 180° to 220° C. suitable for the production of resinoid wheels, a blowing agent which is thermally decomposable at the same temperature as above, and an aggregate. Suitable examples of thermally decomposable substances are organic substances such as starch and funori. Examples of useful blowing agents are those evolving carbon dioxide, nitrogen, water vapor, oxygen or like gas when decomposed on heating, such as sodium hydrogencarbonate, amyl acetate, butyl acetate, diaminobenzene, etc. Examples of suitable aggregates are nonflammable inorganic materials such as chopped strands of glass fibers and asbestos fibers about 5 to 15μ in diameter and cut to a length, for example, of 0.1 to 1 mm.

The pore forming granules are prepared, for example, in the following manner. An aggregate is prepared by cutting minute glass or asbestos fibers about 5 to 15μ in diameter to a length of 0.1 to 1 mm, impregnating the fibers with a dilute liquid phenolic resin solution and drying the fibers. The aggregate is then admixed with the blowing agent and starch or funori.

These ingredients are used in the proportions of 1 to 3 parts by weight, for example, of starch and 0.005 to 0.015 part by weight of the blowing agent per part by weight, for example, of the glass fibers used for the aggregate.

A suitable amount of water is then added to the ingredients, and the mixture is fully kneaded in a small mixer. The mixture is placed into a granulating machine to obtain spherical granules about 1.2 to 1.5 mm in diameter. The granules are slowly dried for 5 to 10 minutes and thereafter dried at 50° to 70° C. The pore forming granules thus obtained are substantially spherical, contain the blowing agent and the thermally decomposable substance and have such mechanical strength that they withstand the pressure of a multiplicity of pairs of rolling rolls. The pore forming granules D are not limited to the above-mentioned example but may be composed of any material insofar as they fulfil the requirements of containing the above-specified substance and blowing agent which are thermally decomposable when subjected to a baking step for the production of abrasive wheels and having the desired mechanical strength to withstand the rolling pressure.

Examples of useful glass fiber reinforcements C include chopped strands of glass fibers 10 to 15μ in diameter and 5 to 15 mm in length. Like the glass and asbestos fibers used as the aggregate for the pore forming granules D, it is preferable to use the glass fiber reinforcement C as surface-treated by being impregnated with a dilute solution of a liquid phenolic resin, followed by drying. The glass fiber reinforcement C reinforces the abrasive wheel and are entangled with the abrasive grains A and the pore forming granules D, holding the granules D in engagement with the abrasive grains A.

Examples of useful hard hollow globules E are those made of a nonflammable inorganic material, such as hollow alumina globules 0.8 to 1.2 mm, preferably about 1 mm, in diameter (trademark "NISSORANDUM BUBLITE," product of Taiheiyo Kinzoku Kabushiki Kaisha, Japan). Such hard hollow globules act to cut metal materials like abrasive grains while at the same time providing their hollow portion as a pore when broken.

Examples of useful fillers are creolite, iron disulfide, red iron oxide, clay, etc.

The ingredients of the abrasive composition are kneaded together for example in the following order.

First, the abrasive grains A and the binder B are kneaded in a first mixer 1*a* on a higher level. Used as the binder B is for example a phenolic resin, about one third of the amount of which is admixed in a liquid form with the abrasive grains A in the first mixer 1*a*.

Pore forming granules D, 1.2 to 1.5 mm in diameter and prepared as described above, are then slowly placed into the mixer 1*a* in rotation by being allowed to slide down a slope at an inclination angle for example of 15 degrees. The granules are mixed with and uniformly dispersed in the kneaded mixture.

The pore forming granules D are used in an amount of 1 to 8 parts by weight, preferably about 3 parts by weight, per 100 parts by weight of the whole binder B.

Subsequently hard hollow globules E, when used, are slowly admixed with and uniformly dispersed in the mixture in the same manner as the granules D. The hard hollow globules E are used in an amount of about 0.3 to 2 parts by weight per 100 parts by weight of the whole binder B.

The hard hollow globular material is not always added to the abrasive composition.

Subsequently chopped strands of glass fiber reinforcement C, 10 to 15μ in diameter and 5 to 15 mm in length, are gradually added to and uniformly dispersed in the uniform mixture of the abrasive grains A, liquid binder B, pore forming granules D and hard hollow globules E. The inorganic reinforcement C is used in an amount for example of 1 to 2 parts by weight per 100 parts by weight of the abrasive grains A. It is preferable to use the glass fibers in two different lengths, e.g. 5 mm and 15 mm, at the same time. Further as already stated, the glass fibers may preferably be surface-treated before use.

On the other hand, the two-third remaining quantity of the phenolic resin is used in the form of particles. The particles of the resin are placed into a second mixer 1b at a lower position and mixed with a filler such as creolite if the filler is used. The abrasive grains A, binder B and filler are used in the ratio for example of 60 to 90 parts by weight of the abrasive grains, 10 to 30 parts by weight of the binder and 0 to 20 parts by weight of the filler. The kneaded mixture in the first kneader 1a is placed into the second mixer 1b, and the combined mass is uniformly kneaded together.

The abrasive mixture run off from the two-stage mixer 1 is a uniform composition and is particulate to granular in its entirety.

The abrasive composition is then charged into the hoppers 25 of two feeders 2. The granular composition is then fed in a specified amount at a time to a lower die 4 in a block molding machine 3 by means of a slitter provided at the outlet of the hopper 25 of each feeder 2 and an intermittently driven conveyor having opposite side walls spaced apart by a distance equal to the width of the slitter. The molding machine 3 includes an upper die 5 positioned at its center and two lower dies 4 alternately reciprocally movable from outside inward to a position immediately below the upper die 5 and outward therefrom. The abrasive composition is subjected by the molding machine 3 to pressure, for example, of 80 to 140 kg/cm$^2$ for 20 to 60 seconds and is thereby molded in succession into blocks having a size in the range of from 260 mm×380 mm×25 mm to 400 mm×500 mm×40 mm. The upper and lower dies 5 and 4 are heated to a temperature, for example, of 50° to 70° C.

The molded block is then transferred by a chute 6 onto a first conveyor 7, which passes the block through a high frequency heater 8 to heat the block for example at a temperature of 45° to 75° C. The high frequency heater 8 is used to instantaneously heat the block to a predetermined temperature throughout its innermost portion, whereby the block is suitably softened owing to the tackiness of the binder and thereby rendered rollable. Furthermore since the interior portion of the block is maintained at a slightly higher temperature than the outside portion of the block, the block can be rolled advantageously without sticking to the rolls. The high frequency heater is more specifically a high frequency induction heater. During the heating step, the pore forming granules remain in their original form as uniformly contained in the block free of any changes.

The block heated by the high frequency heater is then transferred by a second conveyor 9 continuous with the first conveyor 7 to first rolls 10 for rolling. The rolled sheet obtained is then placed onto a first turntable 11, turned 90 degrees and sent by a third conveyor 12 to second rolls 13, whereby the rolled sheet shaped by the first rolls is rolled transversely. The resulting rolled sheet is thereafter carried on a fourth conveyor 14 to third rolls 15 and rolled. The sheet is further transferred onto a second turntable 16, turned through 90 degrees and then carried by a fifth conveyor 17 to a fourth unit of four high-precision rolls 18 which are vertically arranged in a row, whereby the abrasive sheet is eventually made into a sheet measuring 400 to 1,200 mm in width and 1 to 15 mm in thickness. Because the pore forming granules D have such mechanical strength that they withstand the pressure of the multiplicity of pairs of rolls, the uncured abrasive sheet resulting from the rolling step contains the pore forming granules D remaining in their original state and uniformly dispersed therein. Preferably the fourth rolls 18 are covered with rubber, in which case the rolling operation permits the abrasive grains A only to be exposed from the front and rear surface of the sheet, rendering the sheet rough-surfaced. Abrasive wheels having such rough surfaces ensure a very efficient cutting operation. The third, fourth and fifth conveyors 12, 14 and 17 are provided thereabove for example with infrared heaters 22, 23 and 24 or like means to maintain the abrasive sheet at the specified temperature.

The uncured abrasive sheet thus rolled to the predetermined thickness of 1 to 15 mm is then fed by a sixth conveyor 19 to a blanking press 20, by which circular pieces, for example 200 to 860 mm in diameter, are blanked out from the sheet.

The uncured circular abrasive pieces are then fed by a seventh conveyor 21 to a baking furnace (not shown) such as a tunnel-type electric furnace. The scrap resulting from the blanking step is sent by a return conveyor (not shown) to a kneader (not shown) for reuse.

In the baking furnace, the uncured circular pieces are placed between polished iron discs and baked at a temperature suitable for the curing of the synthetic resin used as the binder B. For example, the circular pieces are heated progressively from room temperature to a temperature of 180°-220° C. over a period of about 1 day when a phenolic resin is used as the binder B.

Figure 3:
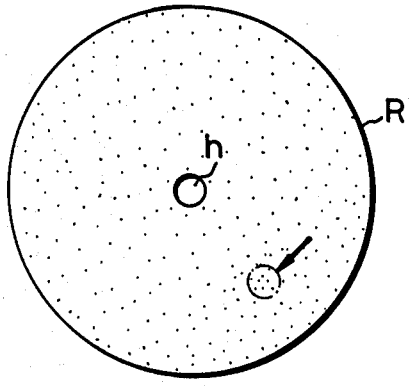
FIG. 3 is a plan view showing a resinoid abrasive wheel of this invention for illustrative purposes.

FIG. 3 shows a resinoid abrasive wheel R in the form of a circular sheet and having a center bore h.

Figure 4:
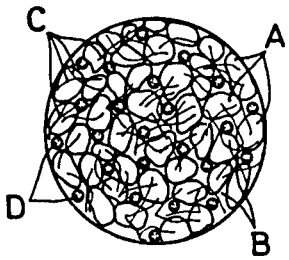
FIG. 4 is an enlarged plan view of a portion of FIG. 3 indicated by an arrow to illustrate the structure of the wheel before baking.

FIG. 4 shows the structure of the wheel R in the uncured state before baking. It is seen that the pore forming granules D are uniformly distributed among numerous abrasive grains A, and the reinforcing inorganic fibers C are entangled with these granules and grains, preventing disengagement of the granules D. The grains A, granules D and fibers C are bonded together by the binder B into a body.

Figure 5:
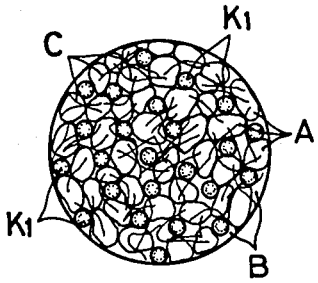
FIG. 5 is an enlarged plan view of the same after baking.

With reference to FIG. 5, the baking operation cures the binder B, eliminates, upon thermal decomposition, at least part of starch or like thermally decomposable substance contained in the pore forming granules and further decomposes the blowing agent contained in the granules D, consequently forming pores K1 at the locations where the granules D were present. As a result, a small amount of glass fiber fragments or like aggregate and a small amount, if any, of undecomposed starch or like substance alone remain at such locations.

Since the pore forming granules D are of substantially equal size and accordingly the granules D each contain an approximately equal amount of the blowing agent as well as of starch or like substance, the pores K1 formed are substantially of uniform size and uniformly distributed throughout the wheel.

Figure 6:
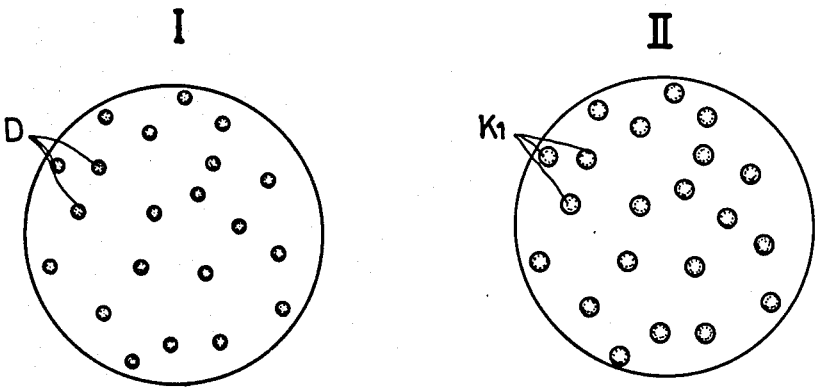
FIG. 6 is an enlarged schematic plan view showing the structure of an embodiment of this invention to illustrate the mechanism through which pores are formed.
Figure 7:
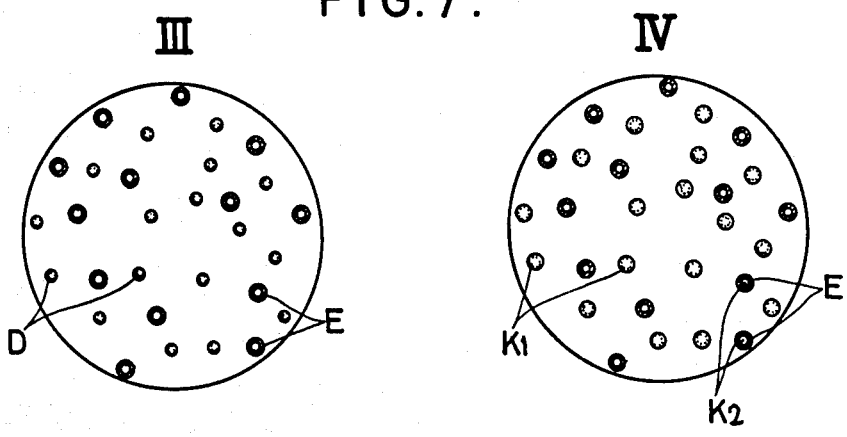
FIG. 7 is an enlarged schematic plan view showing the structure of another embodiment of this invention to illustrate the mechanism through which pores are formed.

FIGS. 6 and 7 schematically show the pores as formed in resinoid abrasive wheels according to this invention.

FIG. 6 shows an embodiment prepared from an abrasive composition containing pore forming granules D but no hard hollow granules E. The abrasive structure (I) on the left-hand side of the figure before baking contains granules D in which the blowing agent remains undecomposed. In the structure (II) on the right-hand side resulting from baking, the blowing agent in the granules has been thermally decomposed with starch or like substance at least partially eliminated on thermal decomposition, thus forming pores K1 at the locations where the granules D were present. The resulting abrasive wheel is suitable for cutting usual steel materials, and special steel materials of relatively small cross section.

FIG. 7 shows another embodiment prepared from an abrasive composition containing both pore forming granules D and hard hollow granules E. In the structure (III) shown on the left-hand side of the figure, the pore forming granules D remain undecomposed before baking, whereas in the right-hand side structure (IV) the granules D have been decomposed on baking, forming pores K1 where they were present. The hard hollow globules E, although remaining free of any changes despite baking, provide their hollow portions as pores K2 when cutting a metal material and broken. Thus the abrasive wheel incorporating the hard hollow granules E has an increased cutting ability and is suitable for cutting superhard manganese steel and like special steel materials of large cross section or ductile and malleable non-ferrous metal materials such as copper with a power as high as 70 to 150 hp.

Apparatus for continuously producing resinoid abrasive wheels described above are disclosed in the applicant's U.S. Pat. No. 3,980,453, No. 3,999,919 and No. 4,115,077.

Examples of this invention will be given below.

EXAMPLE 1

Resinoid abrasive wheels were produced according to the present method with the use of the apparatus shown in FIGS. 1 and 2.

Pore forming granules D were prepared in the following manner. Glass fibers about 5 to 15 μ in diameter were cut to a length of 0.5 to 1 mm, then impregnated with a dilute solution of liquid phenolic resin and thereafter dried to obtain an aggregate. The aggregate was admixed with 0.01 part by weight of a blowing agent and 1 part by weight of starch serving as a thermally decomposable substance per part by weight of the glass fibers used as the aggregate. With addition of a suitable amount of water, the mixture was fully kneaded in an unillustrated small mixer. The kneaded mixture was placed into an unillustrated granulating machine and shaped into spherical granules about 1.2 to 1.5 mm in diameter. The granules were slowly dried for about 5 to 10 minutes and finally dried at 50° to 70° C. The pore forming granules D thus produced were substantially spherical, contained starch and blowing agent and had mechanical strength to withstand the pressure of multiple pairs of rolls.

The following ingredients including the pore forming granules D were kneaded in the two-stage mixer 1 shown in FIGS. 1 and 2 to prepare a resinoid abrasive composition.

| Abrasive composition | Amount | |
|---|---|---|
| Ingredient | kg | parts by weight |
| Abrasive grains A: | 50 | 100 |

-continued

| Abrasive composition | Amount | |
|---|---|---|
| Ingredient | kg | parts by weight |
| Mixture of equal amounts of 20-mesh Alundum A and 24-mesh Alundum A | | |
| Binder B: | | |
| Liquid phenolic resin (BRL-205, BRL-1251) | 3.16 | 6.3 |
| Powdery phenolic resin (BRP-530, BRP-509) (both products of Union Carbide Corporation) | 5.7 | 11.4 |
| Inorganic fiber reinforcement C: | 0.75 | 1.5 |
| Chopped strands of glass fibers 5 to 15 mm in length and 10 to 15μ in diameter | | |
| Pore forming granules D: | 0.15 | 0.3 |
| Filler: Iron disulfide | 8.1 | 16.2 |

The ingredients were kneaded together in the following order. First, the whole amount of the abrasive grains A and the liquid phenolic resin serving as the binder B were kneaded in the first mixer 1*a* to wet the abrasive grains uniformly with the liquid phenolic resin. Next, all the pore forming granules D were slowly placed into the mixer 1*a*, and the grains A, liquid binder B and pore forming granules D were uniformly kneaded together. One half the amount of the inorganic fiber reinforcement C was then placed into the first mixer 1*a* through a screen, and the mixture was uniformly kneaded.

On the other hand, the powdery phenolic resin binder B and iron disulfide serving as the filler were kneaded together in the second mixer 1*b*, and the remaining half amount of the inorganic fiber reinforcement C was uniformly added to the kneaded mixture with the use of a screen. The resulting mixture was uniformly kneaded.

The mixture in the first mixer 1*a* was then placed into the second mixer 1*b*. All the ingredients were thus kneaded together in the second mixer 1*b*.

The resinoid abrasive composition thus prepared in the two-stage mixer 1 was particulate to granular. The composition was charged into the hopper 25 of the feeder 2.

Subsequently the feeder 2 feeded the abrasive composition to the lower die 4 of the block molding machine 3 in a specified amount to an approximately uniform thickness. The machine molded the composition to a block 300 mm×420 mm×30 mm. At this time, the upper and lower dies 5 and 4 were heated to about 50° to 70° C.

The block of the abrasive composition was then heated by the high frequency heater 8 to about 70° C. throughout its interior for 15 to 25 seconds. The pore forming granules D heated in this step remained free of any changes. The heated block was successively rolled by the four stages of rolls 10, 13, 15 and 18 into a 4-mm-thick sheet. The pore forming granules D, having mechanical strength sufficient to withstand the rolling pressure, remained unchanged in the course of the rolling step and were contained in the sheet as uniformly distributed therein.

The sheet was then fed to the blanking press 20, by which circular pieces, 20 inches in diameter, were blanked out from the sheet, with a center bore h of 1 inch in diameter punched in the pieces.

The uncured circular abrasive pieces were finally baked in a furnace at 180° C. in a specified manner, whereby the starch contained in the pore forming granules D was almost wholly decomposed and disappeared, and the blowing agent in the granules D was also thermally decomposed to evolve a gas, forming pores K1 larger than the granules D at the locations where the granules D were present.

The resinoid abrasive wheels thus produced were tested for cutting performance in the following manner.

The abrasive wheel, 20 inches in diameter, 4 mm in thickness and 1 inch in the diameter of center bore, was mounted on an automatic cutting tester (product of Nippon Cutting Machine Manufacturing Co., Ltd., Japan, driven by a 30-hp, 22-kw motor). The work was a solid bar 75 mm in diameter and made of usual steel (JIS S45c).

During the first ten passes of the cutting operation, the abrasive wheel wore away by 0.8 mm per pass on the average. During the following ten passes, the wheel wore away by 1.1 mm per pass on the average. The work was cut with very small to moderate friction and with extreme sharpness. Eighty percent of the cut work surfaces were free of any discoloration, and 20% discolored to brown, hence good results. Further only a few irregularities were left over at the cut edge portion.

The perpendicularity of the cut lines with respect to the axis of the work was 90 to 100%. The perpendicularity indicates the degree of agreement of the actual cut line with the predetermined cut line at right angles to the axis of the work. The perpendicularity of 100% indicates perfect agreement between the two lines.

EXAMPLE 2

Resinoid abrasive wheels were produced in the same manner as in Example 1 except that the abrasive composition contained 0.114 kg (corresponding to 2 parts by weight based on 100 parts by weight of the powdery phenolic resin) of a blowing agent-containing pore forming granules D and 0.057 kg (similarly corresponding to 1 part by weight) of hollow alumina globules 1 mm in average diameter (used as hard hollow granules E, trademark "NISSORANDUM BUBLITE," product of Taiheiyo Kinzoku Kabushiki Kaisha, Japan). The abrasive wheel obtained was tested for cutting performance in the same manner as in Example 1. The wheel cut manganese steel pipes with extreme sharpness and found to have an outstanding cutting ability.

This invention may be embodied differently without departing from the spirit and basic features of the invention. Accordingly the embodiments herein disclosed are given for illustrative purposes only and are not in any way limitative. It is to be understood that the scope of the invention is defined by the appended claims rather than by the specification and that various alterations and modifications within the definition and scope of the claims are included in the claims.

What is claimed is:

1. An improved method of continuously producing a resinoid abrasive wheel for cutting hard materials comprising the steps of preparing pore forming granules having predetermined mechanical strength and containing a substance thermally decomposable at a baking temperature for the production of the resinoid wheel, the thermally decomposable substance being selected from the group consisting of starch and funori, kneading the pore forming granules with abrasive grains and a thermosetting synthetic resin binder to prepare an abrasive composition, molding the abrasive composition into a block, heating the block by a high frequency heater, rolling the heated block containing the pore forming granules into a sheet by a multiplicity of pairs of rolls, blanking out a circular piece from the rolled sheet, and baking the circular piece to cure the binder therein and form pores in the resulting abrasive wheel by the decomposition of at least part of the thermally decomposable substance contained in the granules, wherein the improvement comprises:

(a) adding a blowing agent selected from the group consisting of sodium hydrogen carbonate, amyl acetate, butyl acetate and diaminobenzene, along with the thermally decomposable substance in the step of preparing pore forming granules; and (b) forming pores by the decomposition of at least part of the thermally decomposable substance contained in the granules containing the blowing agent and by the decomposition of the blowing agent contained in the granules while curing the binder contained in the circular sheet in the baking step, the pores being larger than the pore forming granules and located where the pore forming granules were present.

2. A method as defined in claim 1 wherein the pore forming granules comprise 1 to 3 parts by weight of the thermally decomposable substance, 0.005 to 0.015 parts by weight of the blowing agent and 1 part by weight of an aggregate.

3. A method as defined in claim 1 wherein the aggregate is an inorganic material selected from the group consisting of glass fibers and asbestos fibers in the form of particles 5 to 15 $\mu$ in diameter and 0.1 to 1mm in length.

4. A method as defined in claim 1 wherein the pore forming granules are prepared by mixing together an aggregate surface-treated with a dilute solution of a thermosetting resin, the thermally decomposable substance and the blowing agent, kneading the mixture with addition of a suitable amount of water, forming the kneaded mixture into granules by a granulating machine and drying the granules.

5. A method as defined in claim 1 wherein the pore forming granules are spherical granules 1.2 to 1.5 mm in diameter.

6. A method as defined in claim 1 wherein the pore forming granules have mechanical strength sufficient to withstand the molding pressure and the rolling pressure.

7. A method as defined in claim 1 wherein the abrasive grains are of 16- to 220-mesh size and are made of at least one material selected from the group consisting of silicon carbide, alumina and siliceous sand, and the binder is at least one thermosetting synthetic resin selected from the group consisting of phenolic resin, epoxy resin and diallyl phthalate resin.

8. A method as defined in claim 1 wherein at least one filler selected from the group consisting of creolite, iron disulfide, red iron oxide and clay is incorporated into the abrasive composition in the kneading step.

9. A method as defined in claim 1 wherein in the kneading step 60 to 90 parts by weight of the abrasive grains, 10 to 30 parts by weight of the binder, 0 to 20 parts by weight of a filler and 1 to 8 parts by weight, per 100 parts by weight of the binder, of the pore forming granules are kneaded together.

10. A method as defined in claim 1 wherein hard hollow globules are incorporated into the abrasive composition in the kneading step.

11. A method as defined in claim 10 wherein the hard hollow globules are nonflammable inorganic hollow granules 0.8 to 1.2 mm in diameter.

12. A method as defined in claim 10 wherein the hard hollow globules are hollow alumina globules.

13. A method as defined in claim 10 wherein in the kneading step 1 to 8 parts by weight of the pore forming granules and 0.3 to 2 parts by weight of the hard hollow globules are incorporated into the abrasive composition per 100 parts by weight of the binder.

14. A method as defined in claim 1 wherein an inorganic fiber reinforcement of glass fibers is further incorporated into the abrasive composition in the kneading step.

15. A method as defined in claim 14 wherein the inorganic fiber reinforcement is chopped strands of glass fibers 10 to 15 $\mu$ in diameter and 5 to 15 mm in length.

16. A method as defined in claim 14 wherein in the kneading step 1 to 2 parts by weight of the inorganic fiber reinforcement is incorporated into the abrasive composition per 100 parts by weight of the abrasive grains.

* * * * *